United States Patent [19]

Van Den Brom

[11] Patent Number: 4,911,860

[45] Date of Patent: Mar. 27, 1990

[54] SOLID DETERGENT COMPOSITION: POLYALKYLENE-GLYCOL-MONO-ESTER CARRIER AND SYNTHETIC SURFACTANT FOR LAUNDRY PRETREATMENT

[75] Inventor: Guido C. Van Den Brom, Niew Beijerland, Netherlands

[73] Assignee: Lever Brothers Company, New York, N.Y.

[21] Appl. No.: 310,482

[22] Filed: Feb. 14, 1989

Related U.S. Application Data

[63] Continuation of Ser. No. 115,001, Oct. 28, 1987, abandoned.

[30] Foreign Application Priority Data

Oct. 31, 1986 [GB] United Kingdom ..... 8626080

[51] Int. Cl.[4] ..... C11D 3/37; C11D 3/395; C11D 17/00

[52] U.S. Cl. ..... 252/174.21; 252/94; 252/95; 252/99; 252/174; 252/174.25; 252/DIG. 1; 252/DIG. 16

[58] Field of Search ..... 252/174.21, 174.25, 252/174, 94, 99, 95

[56] References Cited

U.S. PATENT DOCUMENTS

| | | | |
|---|---|---|---|
| 2,393,865 | 1/1946 | Wassell | 252/105 |
| 3,332,882 | 7/1967 | Blumbergs et al. | 252/186 |
| 3,715,184 | 2/1973 | Kuhling et al. | 8/111 |
| 3,816,324 | 6/1974 | Fine et al. | 8/111 |
| 3,836,636 | 9/1974 | Kuhling | 8/111 |
| 3,915,633 | 10/1975 | Ramachandran | 3/137 |
| 3,953,353 | 4/1976 | Barrett, Jr. et al. | 252/174 |
| 4,081,395 | 3/1978 | Talley | 252/135 |
| 4,128,494 | 12/1978 | Schirmann et al. | 252/186 |
| 4,295,845 | 10/1981 | Sepulveda et al. | 8/137 |
| 4,363,756 | 12/1982 | Sepulveda et al. | 8/137 |
| 4,450,091 | 5/1984 | Schmolka | 252/DIG. 1 |
| 4,457,857 | 7/1984 | Sepulveda et al. | 8/137 |
| 4,612,135 | 9/1986 | Wenzel | 252/DIG. 14 |

FOREIGN PATENT DOCUMENTS 1246339 9/1971 United Kingdom .

*Primary Examiner*—A. Lionel Clingman
*Attorney, Agent, or Firm*—Matthew J. McDonald

[57] ABSTRACT

A detergent composition, suitably in bar or stick form, comprises synthetic surfactant and carrier system including polyalkylene glycol monoester. The polyalkylene glycol monoester suitably comprises one or more polyethylene glycol monoalkylesters and suitably has a mean molecular weight between 200 and 8000, more suitably between 1000 and 6000. The composition is appropriate for use as a pretreatment stick and can be applied to dry or wet laundry fabrics.

8 Claims, No Drawings

SOLID DETERGENT COMPOSITION: POLYALKYLENE-GLYCOL-MONO-ESTER CARRIER AND SYNTHETIC SURFACTANT FOR LAUNDRY PRETREATMENT

This is a continuation application of Ser. No. 115,001, filed Oct. 28, 1987 now abandoned.

The present invention relates to a detergent composition for use as a pretreatment product. In particular the present invention relates to a product suitable for application to spots and stains on soiled textiles prior to normal laundering of the textiles.

Such products are known. U.S. Pat. Nos. 4,295,845, 4,363,756 and 4,457,857 for example each relate to a product incorporating a particular detergent system.

It is an object of the present invention to provide a detergent pretreatment product which is effective against a range of stain types.

It is a further object of the present invention to provide a detergent pretreatment product which is applicable to wet or dry textiles.

It is a further object of the present invention to provide a detergent pretreatment product which is readily transferable to the fabric being treated and which is removable from the fabric during normal laundering over a wide range of temperatures, for instance 15° to 90° C.

It is a further object of the present invention to provide a detergent pretreatment product which is storage stable at temperatures up to 40° C.

It is a further object of the present invention to provide a detergent pretreatment product in solid, especially although not exclusively, in stick or bar form.

According to of the present invention there is provided a detergent composition comprising synthetic detergent and carrier system including polyalkylene glycol monoester.

An essential ingredient of the present detergent compositions is a synthetic surfactant which may be selected from the group of anionic, nonionic, cationic and zwitterionic surfactants.

The synthetic surfactants are a well-known class of compounds and are extensively described in the art, such as e.g. in Schwartz, Perry, Vol. II, 1958, "Detergents and Surface-active Agents".

In particular, nonionic surfactants have been found suitable for inclusion in the present compositions. They may be employed either alone or in combination with other types of surfactants. Preferably, nonionic surfactants are employed, selected from the classes of alkylene oxide condensation products with fatty alcohols, alkylphenols, fatty acids and fatty acid amides. Particularly preferred are the nonionic surfactants selected from the class of fatty alcohol ethoxylates having HLB values within the range of 9 to 13, in particular 9 to 11, such as e.g. a $C_{12}$–$C_{15}$ alcohol condensed with 4 moles of ethylene oxide per mole of alcohol.

Anionic surfactants suitable for inclusion in the present compositions are preferably those having a large degree of nonionic character, such as the anionic derivatives of alkoxylated nonionic surfactants. Suitable examples are the alkylpolyglycolethersulphonates and carboxylates.

If a higher foam profile is desired than can be achieved with nonionic surfactants, it may be of advantage to include a nonionic-anionic surfactant combination comprising in addition to a nonionic surfactant up to 5% of a high-foaming anionic surfactant such as e.g. a sodium alkyl benzene sulphonate.

The actual amount of the synthetic surfactant is not very critical. It can be included in amounts of up to 50% by weight of the total composition. Preferably, it is included in an amount of 10 to 40% by weight.

The present carrier system includes polyalkylene glycol monoester, which is preferably present in an amount between 1 and 50wt %, more preferably 5 and 40wt %, even more preferably in an amount between 12 and 35 wt %, with respect to the total composition. Preferably the polyalkylene glycol is polypropylene glycol or polyethylene glycol, more preferably polyethylene glycol. The preferred monoesters are mono alkyl esters in which the alkyl ester is derived from one or more fatty acids having a carbon content within the range of from C12 to C22. Preferably saturated fatty acids are employed. Preferred examples are lauric, palmitic and stearic acids. Suitably the ester employed has a HLB value between 1.5 and 20.0, more suitably between 13.0 and 19.5. Preferably, the ester employed is polyethylene glycol mono alkyl ester having a molecular weight between 200 and 8000, more preferably between 400 and 6000, even more preferably between 1000 and 6000. More than one polyalkylene glycol monoester can be employed. The one or mixture of polyalkylene glycol monoesters employed is selected according to gross physical properties desired in the final product. Suitably the polyalkylene glycol monoester(s) is selected according to its melting point, which can determine the storage stability and physical strength of the product in solid form, and its water solubility properties, which can effect its ease of removal from the fabric being treated during any subsequent laundering operation, especially at low temperatures.

If desired, the carrier system can include one or more materials compatible with polyalkylene glycol monoesters, such as polyalkylene glycol diesters. In any such admixture however the polyalkylene glycol monoester should be present in the major amount viz. more than 50 wt %.

Preferably the carrier system includes a particulate material. Suitably the particulate material is an insoluble inorganic material and is selected from the group comprising clays, talcs, calcite and mixtures thereof. For example it can be a kandite material such as kaolin clay. The amount of particulate material is suitably present in an amount between 1 and 50wt %, more suitably between 10 and 30wt %, even more suitably between 15 and 25wt % with respect to the total composition. The actual amount employed in any one case will depend on the nature and amount of the other ingredients present and on the final product form desired. In the case of an end product in the form of stick or bar it is probably essential that some particulate material is present. Preferably not so much should however be employed that viscosity problems during preparation of the product are encountered. As a general guide however a carrier system incorporating a particulate material suitably comprises between 40 and 75wt % of the total composition.

The present compositions may optionally contain bleaching agent, which may be selected from the group of the reducing bleaches and the peroxygen bleaches, the latter type of bleaches being preferred.

The peroxygen bleaching agents are selected from the group of organic peroxy-acids and their salts, the inorganic peroxy-acids and their salts, and mixtures of peroxy-acid precursors and inorganic peroxy-salts which yield organic peroxy-acids in aqueous environment.

Suitable examples of organic peroxy-acids range from the lower peroxy carboxylic acids such as peracetic acid to the higher peroxy carboxylic acids, in particular the di-peroxygen carboxylic acids, such as di-peroxygen dodecanoic acid.

Suitable examples of the inorganic peroxy-acids are the group VA and VIA peroxides, such as peroxymonophosphoric acid, peroxydiphosphoric acid, peroxymonosulphuric acid and peroxydisulphuric acid. Also the alkali metal and ammonium salts thereof are suitable. Preferred is peroxymonosulphate, commercially available in the form of the triple salt $KHSO_5$: $KHSO_4$: $K_2SO_4$ in the molar ratio of about 2:1:1.

The group of bleaching agents preferred for inclusion in the present compositions are the mixtures of peroxy-acid precursors and inorganic peroxy-salts delivering a bleaching action at low temperatures. Peroxy-acid precursors are well known in the art and are described e.g. in British Pat. No. 836,988, 855,735 and 970,356, 1,246,339 in U.S. Pat. Nos. 3,332,882 and 4,128,494, in Canadian Pat. No. 844,481 and in a series of articles by A. H. Gilbert in Detergent Age, June 1967, pages 18–20, July 1967, pages 30–33 and August 1967, pages 26, 27 and 67. Preferred peroxy-acid precursors are tetraacetylethylene diamine (TAED), tetraacetylglycoluril (TAGU), glucose pentaacetate (GPA), xylose tetraacetate (XTA), and the group of acyloxy benzene sulphonates.

Inorganic peroxy-salts suitable for use in combination with a precursor are also well known and include the alkali metal perborates (mono- or tetrahydrate), percabonates and persilicates. The preferred member of this group is sodium perborate.

The ratio by weight of the inorganic peroxy-salt to the peroxy-acid precursor should lie within the range of from 8:1 to 1:1, and preferably lies within the range of from 4:1 to 1.5:1.

The amount of bleaching agent is conveniently expressed in terms of the amount of available oxygen, i.e. the amount of oxygen which can theoretically be delivered at application. The bleaching agent is included in the present compositions in an amount corresponding to from 0.5 to 5% by weight of available oxygen. Preferably, the amount of available oxygen lies within the range of from 1.5 to 3% by weight.

When considering reducing bleaches it will be understood that the amounts should be included which deliver bleaching action which is equivalent to the above ranges for available oxygen.

The detergent pretreatment compositions may further contain conventional minor ingredients, such as lipolytic, proteolytic and amylolytic enzymes, monocarboxylic acid salts, bleach stabilisers such as e.g. the phosphonate bleach stabilisers, optical brightening agents, perfumes, dyes, whiteners, moisture-adsorbents such as anhydrous salts, and the like.

The detergent pretreatment compositions may be prepared by any convenient method for example by extruding or by casting. In a preferred method first the polyalkylene glycol monoester and the synthetic surfactant are mixed and heated up to between about 60° and 70° C. Subsequently, the peroxygen bleach, optionally followed by the precursor, is added while continuously stirring until a homogeneous mix is obtained. After preparation, the compositions are cast and solidified to the desired shape by cooling to ambient temperature.

The detergent pretreatment compositions may be cast and solidified to any desired shape, but preferably are shaped to sticks suitable for application in screw-up or push-up stick holders, thereby providing the customer with a very convenient product form. To this purpose, the composition in still liquid form can simply be cast in the stick holder without the need of any lubricant. Alternatively the product can be in the form of a stick with a wrap-around covering.

In use, the present composition can be applied to stains and spots on either dry fabric or fabric that has been dampened with water. Following either mode of application the fabric is then subjected to a normal laundering process. Direct application to a dry fabric is usually more convenient for the user. When applied to a dry fabric, the composition acts on the spot or stain during an early part of the normal laundering process and is removed during a later part of the laundering process. When applied to a fabric already dampened with water best results are obtained if some time, for example about 5 minutes, is allowed to elapse in order to give the composition time to act on the spot or stain prior to the normal laundering process.

Embodiments of the present invention will now be described by way of example only with reference to the following Examples:

EXAMPLES 1 to 4

Detergent pretreatment sticks were made according to the formulations contained in Table I, in which the stick ingredients are given in weight percentage amounts with respect to the final stick composition.

TABLE I

| Example | 1 | 2 | 3 | 4 |
|---|---|---|---|---|
| PEG 6000 monolaurate | 5.0 | 10.0 | 15.0 | 20.0 |
| PEG 400 monolaurate | 25.0 | 20.0 | 15.0 | 10.0 |
| nonionic $C_{13-15}$ 4EO | 30.0 | 30.0 | 30.0 | 30.0 |
| sodium perborate monohydrate | 12.0 | 12.0 | 12.0 | 12.0 |
| tetraacetylethylenediamine | 4.0 | 4.0 | 4.0 | 4.0 |
| kaolin clay | 22.6 | 22.6 | 22.6 | 22.6 |
| calcium dequest | 1.4 | 1.4 | 1.4 | 1.4 |

Each stick contained different amounts of each of PEG 6000 monolaurate (i.e. polyethyl eneglycol monolaurate having an average approximate molecular weight of 6000) which had an HLB of 19.3 and PEG 400 monolaurate (i.e. polyethyleneglycol monolaurate having an average approximate molecular weight of 400) which had an HLB of 3.0. The remaining ingredients were the same in each stick. "Nonionic $C_{13-15}$ 4EO" means a fatty alcohol ethoxylate derived from a $C_{13-15}$ alcohol condensed with 4 moles of ethylene oxide per mole of alcohol. The calcium dequest contained 35wt % active material.

In each case the stick was prepared by admixing the PEG monolaurates and the nonionic surfactant at 70° C. at which temperature the mixture is fully molten. The mixture is then cooled somewhat an the remaining ingredients stirred in. The still liquid mixture is poured directly into stick holders and allowed to set.

EXAMPLES 5 to 7

Detergent pretreatment sticks were made according to the formulations contained in Table II, in which the stick ingredients are given in parts by weight with respect to the final stick compositions.

TABLE II

| Example | 5 | 6 | 7 |
|---|---|---|---|
| PEG 4000 monolaurate | 10.0 | 20.0 | 30.0 |
| nonionic $C_{13-15}$ 4EO | 30.0 | 30.0 | 30.0 |
| sodium perborate monohydrate | 12.0 | 12.0 | 12.0 |
| tetraacetylethylenediamine | 4.0 | 4.0 | 4.0 |
| kaolin clay | 22.6 | 22.6 | 22.6 |
| calcium dequest | 1.4 | 1.4 | 1.4 |

PEG 4000 monolaurate stands for polyethylene glycol monolaurate having an average approximate molecular weight of 4000 and had an HLB of 19.0 and nonionic $C_{13-15}$ 4EO has the meaning given above. The calcium dequest contained 35wt % active material. Sticks of examples 5, 6 and 7 were prepared by the procedure outlined for Examples 1 to 4.

EXAMPLES 8 AND 9

Detergent pretreatment sticks were made according to the formulations contained in Table III, in which the stick ingredients are given in weight percentage amounts with respect to the final stick composition.

TABLE III

| Example | 8 | 9 |
|---|---|---|
| PEG 6000 monolaurate | 15.00 | 15.0 |
| PEG 400 monolaurate | 20.0 | 15.0 |
| nonionic $C_{13-15}$ 4EO | 30.0 | 30.0 |
| sodium perborate monohydrate | 12.0 | 12.0 |
| tetraacetylethylenediamine | 4.0 | 4.0 |
| kaolin clay | 17.6 | — |
| talc | — | 22.6 |
| calcium dequest | 1.4 | 1.4 |

PEG 6000 monolaurate, PEG 400 monolaurate and nonioinc $C_{13-15}$ 4E0 have the meanings given under Examples 1 to 4. The calcium dequest contained 35wt % active material. Each stick was prepared according to the procedure given for Examples 1 to 4.

Each of the products of Examples 1 to 9 on cooling set to a firm consistency and was storage stable at temperatures up to 40° C. In use the stick could be moved out of its holder, either by a screw-type action or by merely pushing, and retained its shape in use.

In us the exposed part of the stick was rubbed onto the spotted or stained portion of the fabric in a dry state. In each case the composition transferred readily to the fabric. Each test fabric was subjected to a normal laundering process in an automatic washing machine at a range of temperatures. In each case the composition was removed from the fabric during the laundering operation and the stained area of the fabric was satisfactorily washed.

I claim:

1. A detergent pretreatment composition which is in the form of a shaped solid article, in stick or bar form, which comprises (i) a carrier system comprising polyalkylene glycol mono alkyl ester having a mean molecular weight of at least 200, wherein the alkyl ester is derived from 1 or more fatty acids having a carbon content within the range of from C12 to C22, and wherein the polyalkylene glycol mono alkyl ester is present in an amount from 5 to 50 wt. % with respect to the total composition, (ii) from 1 to 50wt. % of a synthetic surfactant which is other than said polyalkylene glycol mono alkyl ester, and which surfactant is selected from the group consisting of anionic, nonionic, surfactants and mixtures thereof, these two elements (i) and (ii) being present together with either iii) one or more bleaching agents selected from the group consisting of reducing bleaches and peroxygen bleaches, the amount in total of bleaching agents corresponding to from 0.5 to 5.0 wt .% of available oxygen, or the equivalent for reducing bleaches, the carrier system alternatively comprising (iv) between 1 and 50 wt. % with respect to the total composition of a particulate material selected from the group consisting of clays, talcs, calcite and mixtures thereof.

2. A composition according to claim 1 wherein the synthetic surfactant comprises 10 to 40 wt % of the composition and is a nonionic surfactant selected from the group consisting of alkylene oxide condensation products with fatty alcohols, alkylphenols, fatty acids and fatty acid amides.

3. A composition according to claim 1 wherein the polyalkylene glycol monoester comprises one or more polyethylene glycol monoalkylesters wherein the alkyl ester is derived from one or more fatty acids having a carbon content within the range of from C12 to C22.

4. A composition according to claim 3 wherein the polyethylene glycol monoalkylester has a mean molecular weight between 200 and 8000.

5. A composition according to claim 4 wherein the polyethylene glycol monoalkylester has a mean molecular weight between 1000 and 6000.

6. A composition according to claim 1, wherein the polyalkylene glycol ester is present in an amount between 12 and 35 wt % with respect to the total composition.

7. The composition according to claim 1 further comprising a bleach precursor.

8. The composition according to claim 7 wherein the bleaching agent is sodium perborate and the bleach precursor is tetraacetylethylene diamine.

* * * * *